US008425165B2

(12) United States Patent
Harada et al.

(10) Patent No.: US 8,425,165 B2
(45) Date of Patent: Apr. 23, 2013

(54) PALLET APPARATUS

(75) Inventors: Susumu Harada, Saitama (JP); Takashi Suzuki, Saitama (JP); Tsuyoshi Abe, Tokyo (JP); Tomoaki Arai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/137,784

(22) Filed: Sep. 13, 2011

(65) Prior Publication Data

US 2012/0067253 A1 Mar. 22, 2012

(30) Foreign Application Priority Data

Sep. 17, 2010 (JP) ..... 2010-210016

(51) Int. Cl.
*B60P 7/06* (2006.01)

(52) U.S. Cl.
USPC ..... 410/46

(58) Field of Classification Search ..... 410/46; 108/55.1
See application file for complete search history.

(56) References Cited

U.S. PATENT DOCUMENTS 5,417,167 A * 5/1995 Sadr ..... 108/57.19
7,555,879 B1 7/2009 Utz et al.
7,922,159 B2 * 4/2011 Troxler ..... 269/71
8,157,093 B2 * 4/2012 Ishikawa et al. ..... 206/386
2005/0150194 A1 7/2005 Okamuro
2007/0000920 A1 1/2007 Naruishi et al.
2009/0025342 A1 1/2009 Ishikawa et al.

FOREIGN PATENT DOCUMENTS

EP 1 547 931 6/2005
JP 07-040992 2/1995
JP 3615631 B2 2/2005
JP 4309245 B2 8/2009

OTHER PUBLICATIONS

Search Report dated Dec. 28, 2011 issued in corresponding European Application No. 11181116.2.

* cited by examiner

*Primary Examiner* — H Gutman
(74) *Attorney, Agent, or Firm* — Harness, Dickey & Pierce, PLC

(57) ABSTRACT

A pallet apparatus includes a pallet base including a caster unit and a mounting plate for mounting a product having a first fastening unit; a fixing member disposed between the product and the mounting plate of the pallet base; and a second fastening unit fixing the fixing member onto the mounting plate. The product can be fixed to or released from the fixing member by fastening or unfastening the first fastening unit. The fixing member includes a slit at a position corresponding to the first fastening unit, the slit allowing the fixing member to be inserted between or detached from the product and the mounting plate without contacting the first fastening unit.

18 Claims, 19 Drawing Sheets

200
210
211
220
230
260
A
B
C

PALLET APPARATUS

BACKGROUND OF THE INVENTION

1. Field of the Invention

The disclosure herein relates to a pallet apparatus for transporting, loading/unloading, or storage of a relatively heavy piece of equipment or product, such as a large copy machine on casters.

2. Description of the Related Art

A piece of heavy equipment or product such as a copy machine on casters is often supported on a steel pallet with high rigidity and packaged thereon for storage, loading/unloading, or transport. In this case, the equipment or product needs to be properly fixed or supported on the pallet while considering anti-vibration properties or shock-absorbing properties. For this purpose, various pallet apparatuses and attaching mechanisms have been proposed.

Japanese Patent No. 3615631 ("Patent Document 1") discusses a supporting structure of an equipment mounting pallet. In this structure, a concave groove portion is formed in an upper surface of a deck board of a pallet, and a resilient member is inserted in the concave groove portion. Casters on a product are resiliently supported on the resilient member, which is substantially flush with the upper surface of the deck board. A fixing member is inserted between the lower surface of the product and the upper surface of the deck board. The product is fixed by fastening a bolt in threaded engagement with the product or a nut welded onto the deck board with one hand.

Some image forming apparatus are large and heavy. A heavy image forming apparatus may be equipped with casters so that it can be moved on a flat surface, such as the floor, without using loading/unloading equipment, such as a forklift. Such a large and heavy product may be mounted on the pallet by fixing the product on a fixing member disposed on the pallet and then fixing the fixing member onto the pallet by using a fastening unit. In this case, the casters on the product may be located above and away from the mounting surface of the pallet, so that the weight of the product is received by the pallet via the fixing member.

Such large and heavy products are typically mounted on the pallet in the factories or storehouses. In this case, the product can be lifted and placed on the fixing member disposed on the pallet by using a loading/unloading apparatus such as a forklift. Thus, the product can be lowered onto the fixing member on the pallet by using the loading/unloading apparatus. The pallet with the product may then be transported and unloaded at the location of installation of the product. The unloading may involve releasing the product from the fixing member, and then releasing the fixing member from the pallet. The product is then lifted in order to allow the fixing member to be detached, and thereafter the product is lowered from the pallet fixing member onto the installation surface.

During the operation of releasing the product from the pallet and lowering the product from the mounting surface of the pallet on to the installment surface, a lifting machine attached to the loading deck of a truck may be used to lower the mounting surface of the pallet to the same height as the installation floor so that the product can be transported on casters. Alternatively, an unloading ramp may be provided between the mounting surface and the installation floor so that the product can be moved on casters.

The product is often unloaded at the place of installation, such as in the office. Such places are typically not provided with loading/unloading equipment, such as a forklift. In this case, it is difficult to lift and release the product from the pallet with the conventional structure of the pallet.

SUMMARY OF THE INVENTION

In one aspect, there is provided a pallet apparatus including a pallet base including a caster unit and a mounting plate for mounting a product having a plurality of screws having a variable amount of protrusion from a bottom surface of the product; a plurality of fixing members configured to support the product on the mounting plate of the pallet base at areas corresponding to a plurality of sides of the bottom surface of the product; and a fastening member configured to fix the plurality of fixing members onto the mounting plate of the pallet base. The product can be fixed on the plurality of fixing members by threading a threaded portion of the plurality of screw members into the bottom surface of the product. The plurality of fixing members include a lower surface portion configured to contact the mounting plate of the pallet base, an upper surface portion configured to contact the bottom surface of the product, and an upright portion connecting the upper surface portion and the lower surface portion, the upright portion being disposed at an inside position when the plurality of fixing members are disposed between the product and the mounting plate. The lower surface portion includes a head portion installing slit opened on the side of the upright portion and located at a position corresponding to a position of the plurality of screw members, the head portion installing slit having a width allowing a head portion of the plurality of screw members to directly contact the mounting plate without contacting the lower surface portion. The upper surface portion includes a threaded portion inserting slit opened on the side of the upright portion and located at a position corresponding to the position of the plurality of screw members, the threaded portion inserting slit having a width allowing the passage of the threaded portion but not the head portion of the plurality of screw members, so that the product can be fixed on the upper surface portion by the plurality of screw members between the bottom surface of the product and the mounting plate. The upright portion includes a head portion passing slit continuous with the threaded portion inserting slit and the head portion installing slit and having a width allowing the passage of the head portion of the plurality of screw members. The fastening member is configured to enable the plurality of fixing members to be fastened to or released from the pallet base from outside the upright portion, with the product fixed on the plurality of fixing members with the plurality of screw members.

In another aspect, there is provided a pallet apparatus including a pallet base including a caster unit and a mounting plate for mounting a product having a plurality of screws having a variable amount of protrusion from a bottom surface of the product, a plurality of fixing members configured to be disposed between the product and the mounting plate of the pallet base and configured to support the product on the mounting plate of the pallet base. The plurality of fixing members include a lower surface portion configured to contact the mounting plate of the pallet base, an upper surface portion configured to contact the bottom surface of the product, and an upright portion disposed at an inside position when the plurality of fixing members are disposed between the product and the mounting plate, the upright portion connecting the upper surface portion and the lower surface portion. The lower surface portion includes a first slit for installing a head portion of the plurality of screw members and having a width such that the head portion of the plurality of screw members does not contact the lower surface portion, the first slit being located at a position corresponding to the plurality of screw members and opened on the side of the upright portion. The upper surface portion includes a second slit for passing a threaded portion of the plurality of screw members, the second slit having a width allowing the passage of the threaded portion of the plurality of screw members but not the head portion of the plurality of screw members. The upright portion includes a third slit for passing the head portion of the plurality of screw members, the third slit being continuous with the first slit and the second slit and having a width allowing the passage of the head portion of the plurality of screw members. The plurality of fixing members can be fixed to or released from the pallet apparatus by adjusting the amount of protrusion of the plurality of screw members from the bottom surface of the product.

In another aspect, there is provided pallet apparatus including a pallet base including a caster unit and a mounting plate for mounting a product having a first fastening unit; a fixing member disposed between the product and the mounting plate of the pallet base; and a second fastening unit configured to fix the fixing member onto the mounting plate. The product can be fixed to or released from the fixing member by fastening or unfastening the first fastening unit. The fixing member includes a slit at a position corresponding to the first fastening unit, the slit allowing the fixing member to be inserted between or detached from the product and the mounting plate without contacting the first fastening unit.

DETAILED DESCRIPTION OF THE PREFERRED EMBODIMENTS

In accordance with an embodiment, a pallet apparatus includes a pallet base on which a pair of fixing members are disposed, where a product is mounted and fixed on the fixing members. The product includes a first fastening unit and a caster unit for enabling the product to be moved on a flat surface. The first fastening unit may include a plurality of screw members attached to a bottom surface of the product. The screw members may be used for adjusting the height or inclination of the product when mounted on the pallet base or installed on an installment surface.

When fixing the product on the pallet base, the product may be fixed onto the fixing members with the screw members, and the fixing members in turn may be fixed onto the pallet base with a second fastening unit, which may include a plurality of fixing bolts. The fixing members include a lower surface portion, an upper surface portion, and an upright portion connecting the lower and upper surface portions, forming a U-shaped cross section. The fixing members are disposed on the pallet base such that their upright surfaces are opposite to one another.

In a preferred embodiment, a head portion installing slit is formed in the lower surface portion of the fixing members so that the product can be directly supported on the pallet base via a head portion of the screw members. Further, a threaded portion inserting slit is provided in the upper surface portion of the fixing members for passing a threaded portion of the screw members when detaching the fixing members. In the upright portion of the fixing member, a head portion passing slit is provided for passing the head portion of the screw members.

When releasing the product, the screw members are rotated out in order to lift the product over the pallet base, and then the fixing members, after removing the fixing bolts therefrom, are detached. Thereafter, the screw members are rotated back in with a wrench or the like until the product can be supported on the pallet base via the caster unit. In accordance with the present embodiment, the product can be released from the pallet base without using loading/unloading equipment, such as a forklift, by retaining or "floating" the product above the fixing members by using the screw members on the pallet base.

In the following, the pallet apparatus according to various embodiments of the present invention are described. While the pallet apparatus may be hereinafter described as being adapted for mounting a large and heavy copy machine, the apparatus or product that is mounted on the pallet apparatus according to various embodiments of the invention is not limited to copy machines.

Embodiment 1

Figure 1:
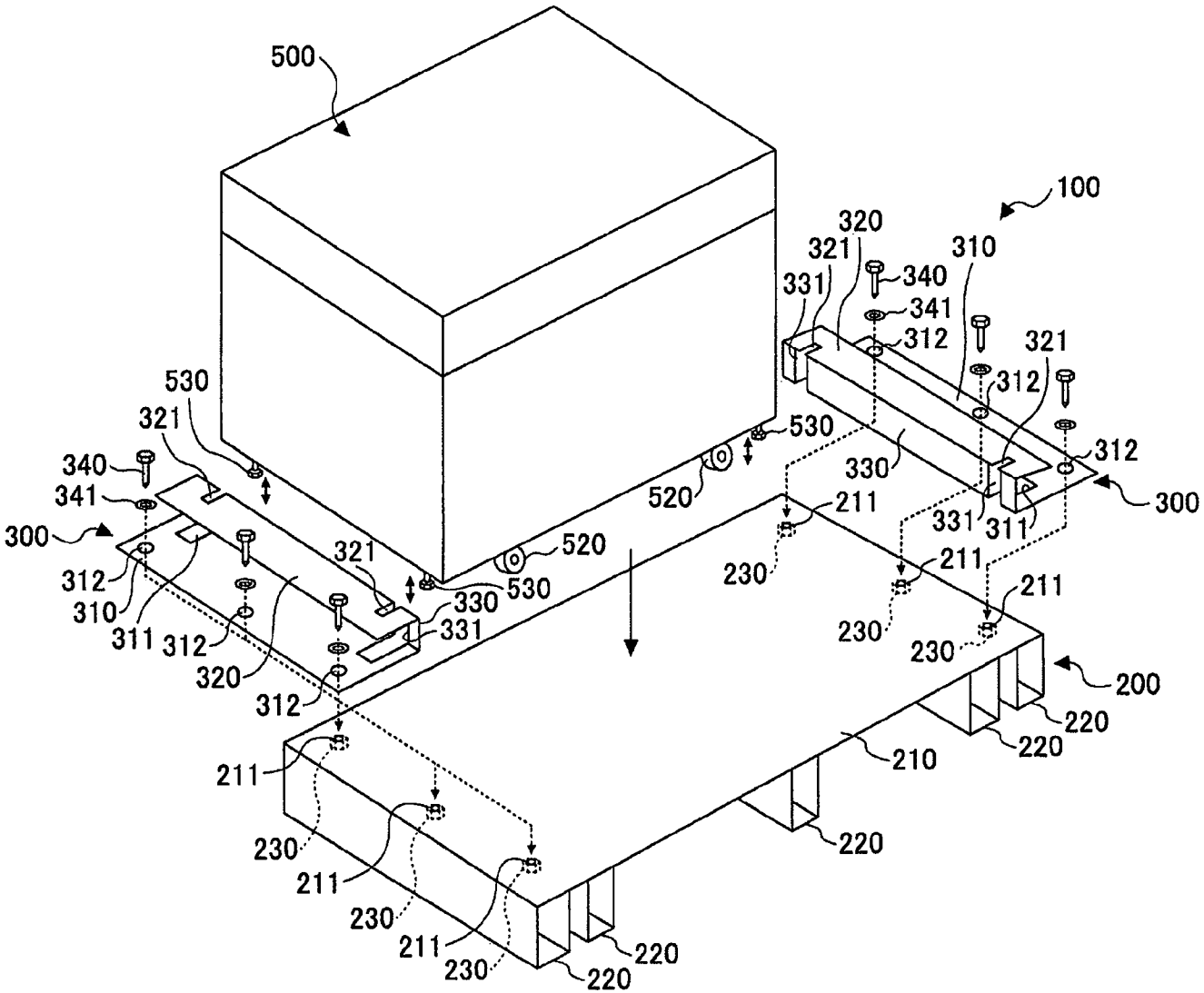
FIG. 1 is an exploded perspective view of a pallet apparatus according to an embodiment of the present invention.
Figure 2A:
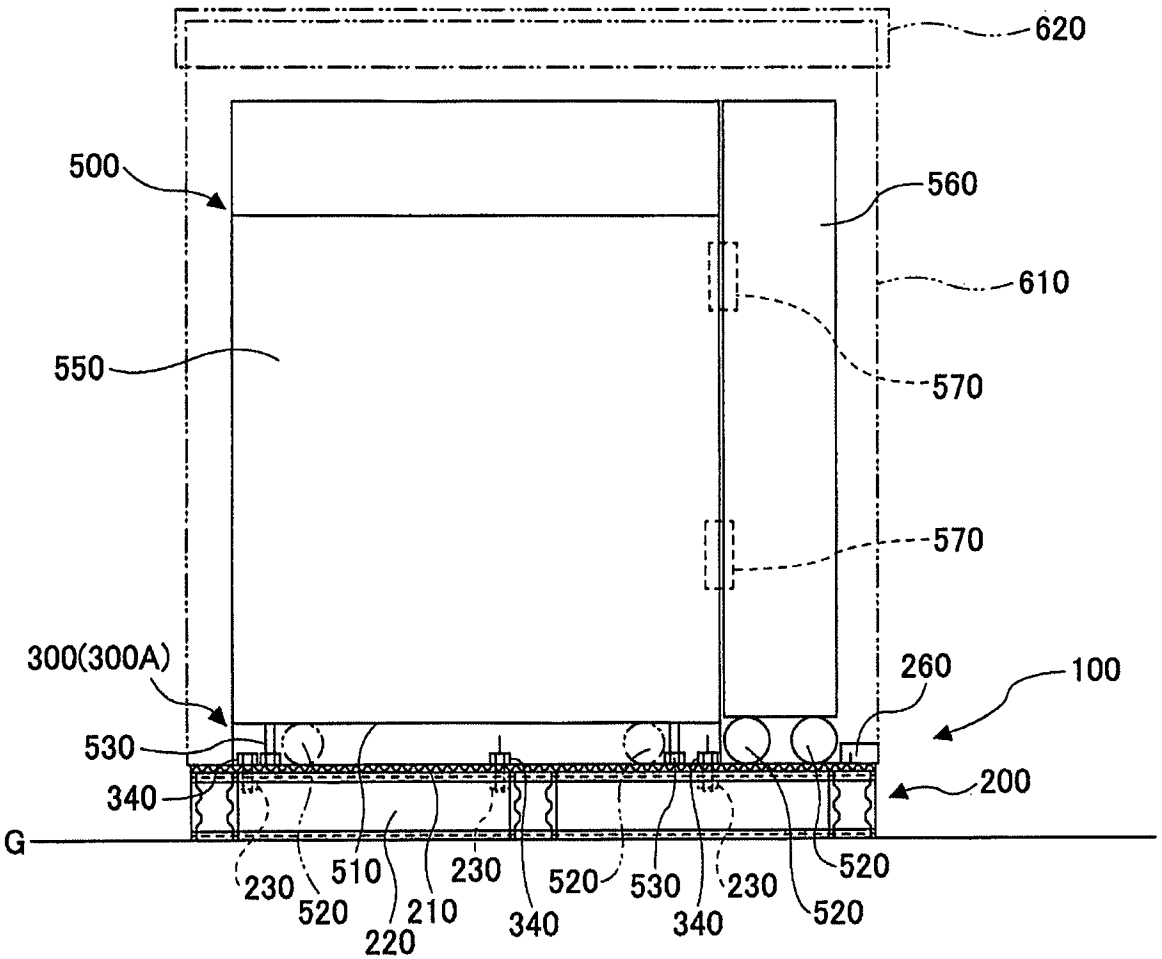
FIG. 2A is a front view of a product mounted on the pallet apparatus.
Figure 2B:
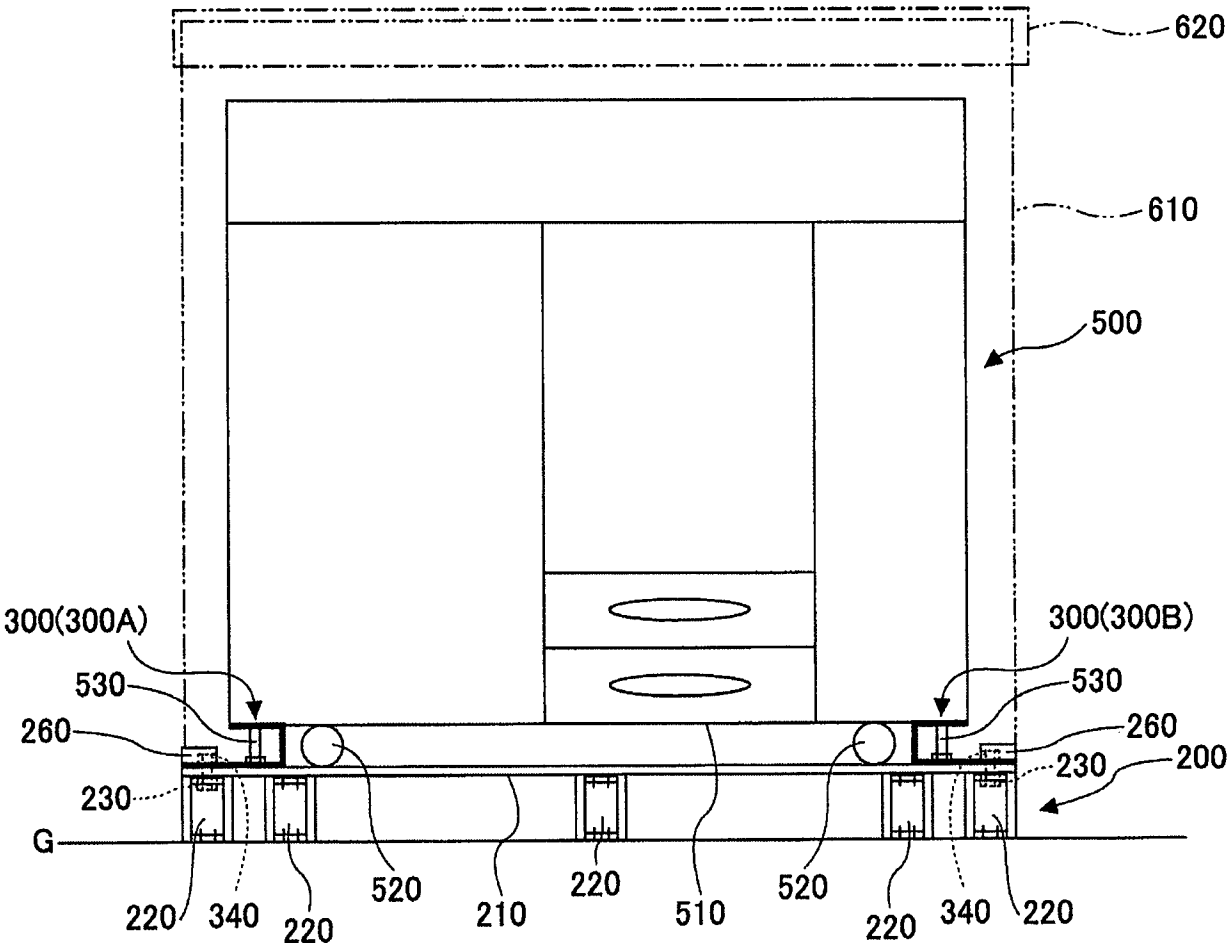
FIG. 2B is a side view of the product mounted on the pallet apparatus.

FIG. 1 is an exploded perspective view of a pallet apparatus 100 according to Embodiment 1, illustrating how the components of the pallet apparatus 100 are assembled. FIGS. 2A and 2B are a side view and a front view, respectively, of the product 500 mounted on the pallet apparatus 100. In accordance with the pallet apparatus 100 of the present embodiment, the product 500 is mounted and fixed on a pallet base 200 via two fixing members 300. The number of the fixing members 300 is not particularly limited. In FIGS. 2A and 2B and other figures, reference sign "G" indicates a floor surface.

In the illustrated example, the fixing members 300 are disposed under two of the four sides of a bottom surface 510 of the product 500, namely the two short sides parallel to each other. The location of the fixing members 300 is not limited to the short sides. However, when the fixing members 300 are located on the short sides, the forks of the forklift can be inserted from the long sides of the product 500, so that the interval of the two forks can be increased, thus enabling a stable loading/unloading operation. Preferably, the fixing members 300 may be located at three or more sides of the product 500.

In accordance with the present embodiment, the product 500 may include a large image forming apparatus. The product 500 includes a plurality of caster units 520 on a bottom surface 510. FIG. 1 illustrates the product 500 having four caster units 520. FIG. 2 illustrates the product 500 having eight caster units 520 when the product 500 includes an image forming unit and a control unit, which will be described later. The product 500 also includes a plurality of screw members 530 (first fastening unit) as installed-state adjusting members for adjusting the height or inclination of the product 500 upon installation. In the illustrated example, the product 500 has four screw members 530, two each inside each of the short sides of the product 500.

Each of the screw members 530 includes a threaded portion 531 with a maximum diameter d (see FIG. 11) and a head portion 532 on one end of the threaded portion 531, which has a maximum diameter D. By rotating the head portion 532 with a tool such as a wrench, the screw members 530 can be threaded into (upward) or out of (downward) the bottom surface 510. Thus, the product 500 can be supported with the caster units 520 retained above a contact surface. The location of the caster units 520 or the screw members 530 may be determined by the weight balance of the product 500 and may not necessarily correspond to the two short sides.

The product 500 may include an image forming unit 550 and a control unit 560 which are mechanically and electrically connected to each other by engaging portions 570. The screw members 530 may be provided only on the image forming unit 550 so that, when the product 500 is mounted on the installation surface via the screw members 530, the control unit 560 can be supported by the image forming unit 550 via the engaging portions 570.

The product 500 is disposed on the pallet base 200 via the fixing members 300. The product 500 is fixed on the fixing members 300 by threading the screw members 530. The fixing members 300 are fixed on the pallet base 200 by using a second fastening unit including fixing bolts 340 and welded nuts 230 welded on the pallet base 200 (see FIGS. 1, 4A, and 11, for example).

Figure 3:
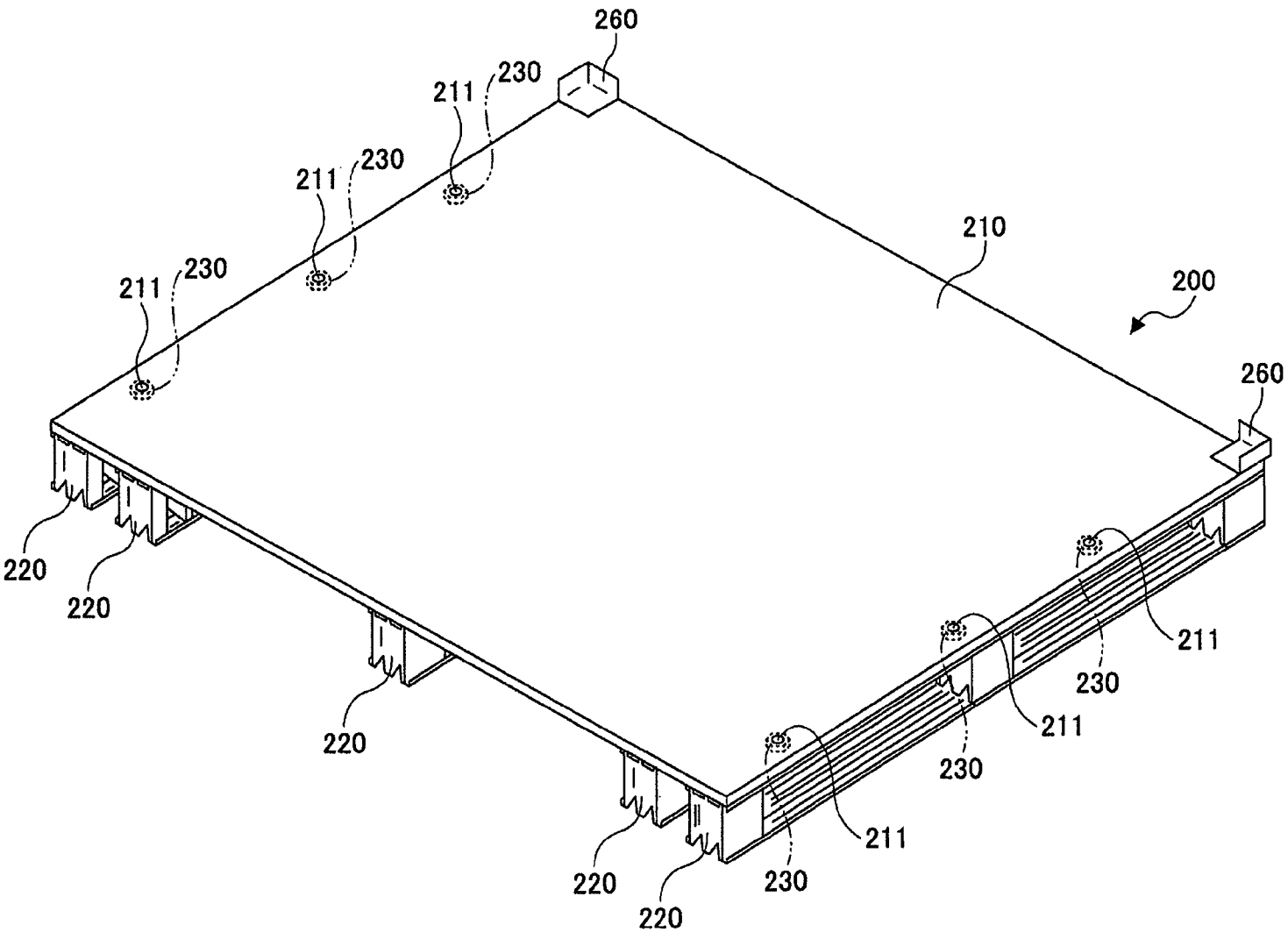
FIG. 3 is a perspective view of a pallet base of the pallet apparatus.
Figure 5A:
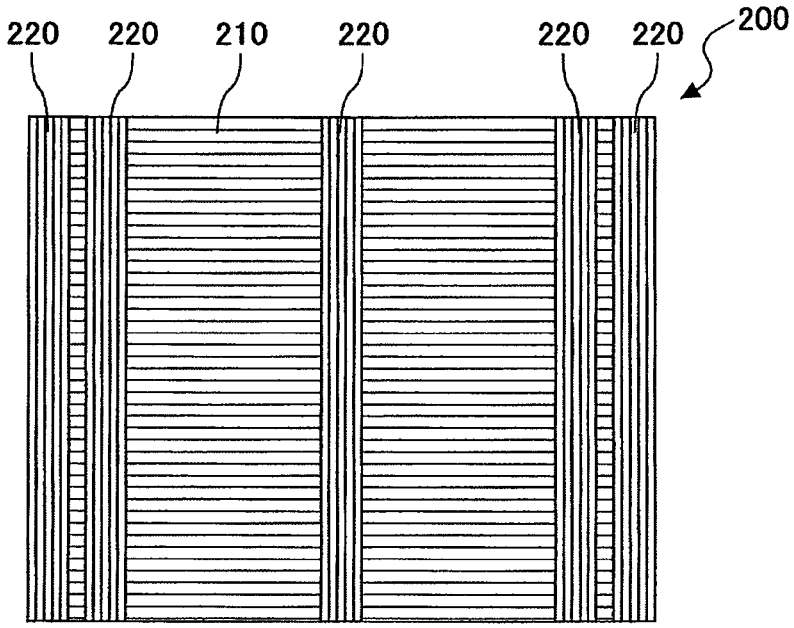
FIG. 5A is a plan view of the pallet base.
Figure 5B:
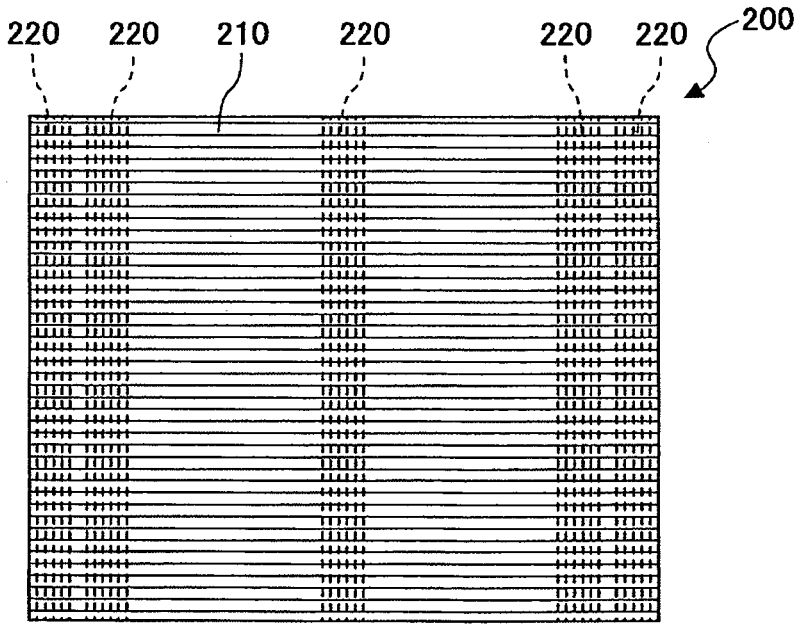
FIG. 5B is a cross section taken along line A-A of FIG. 4D.
Figure 5C:
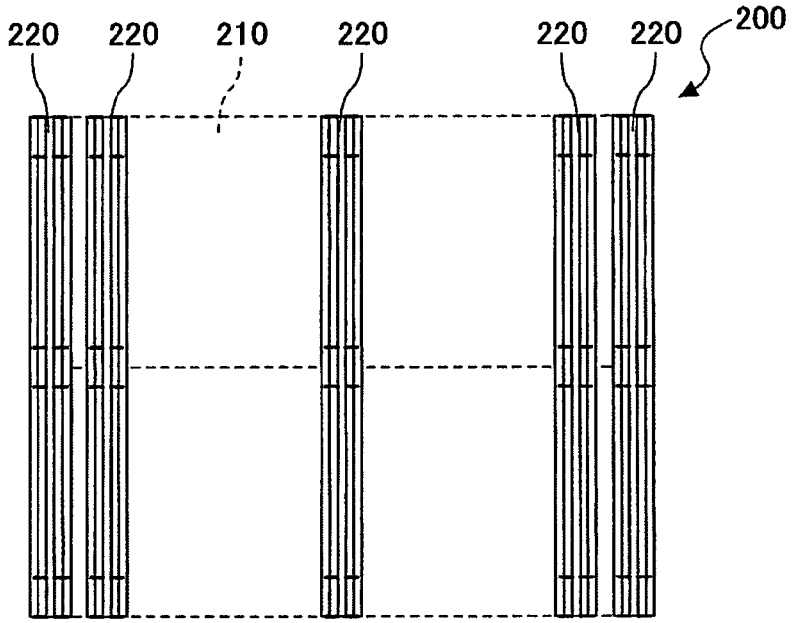
FIG. 5C is a cross section taken along line B-B of FIG. 4D.
Figure 5D:
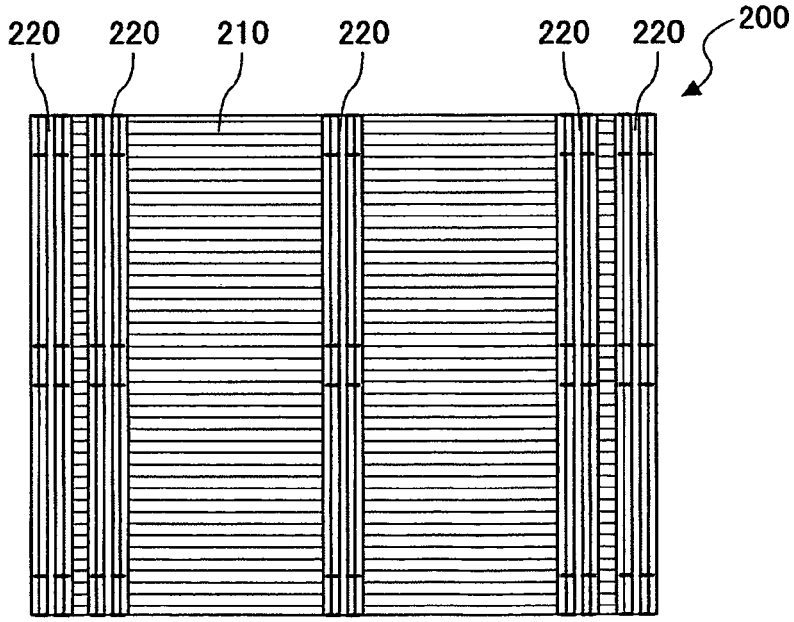
FIG. 5D is a cross section taken along line C-C of FIG. 4D.

Referring to FIG. 3, the pallet base 200 includes a mounting plate 210 and a plurality of (such as five) beam members 220 attached to a lower surface of the mounting plate 210 by spot-welding, for example. The mounting plate 210 provides a product mounting area. In accordance with the present embodiment, the mounting plate 210 may include a board member having a number of reinforcing grooves to which a flat plate is spot welded, as illustrated in FIGS. and 2A and 5B, for example. The beam members 220 may include square pipe members having reinforcing grooves, as illustrated in FIGS. 3 and 5A, for example. The position of attachment of the beam members 220 to the mounting plate 210 may be determined in view of the positions of the caster units 520 which are subject to the weight of the product 500, and the screw members 530 and the fixing members 300. The mounting plate 210 and the beam members 220 may be made of steel plates, such as hot-dip galvanized steel plates, so that they can support heavy items and withstand shocks during loading or unloading. The pallet base 200 allows the insertion of the forks of a forklift from any of the four sides of the pallet base 200. Depending on the weight of the product to be mounted, for example, the pallet base 200 may be made of a material other than steel, such as a synthetic resin.

Figures 4A, 4B, 4C, 4D:
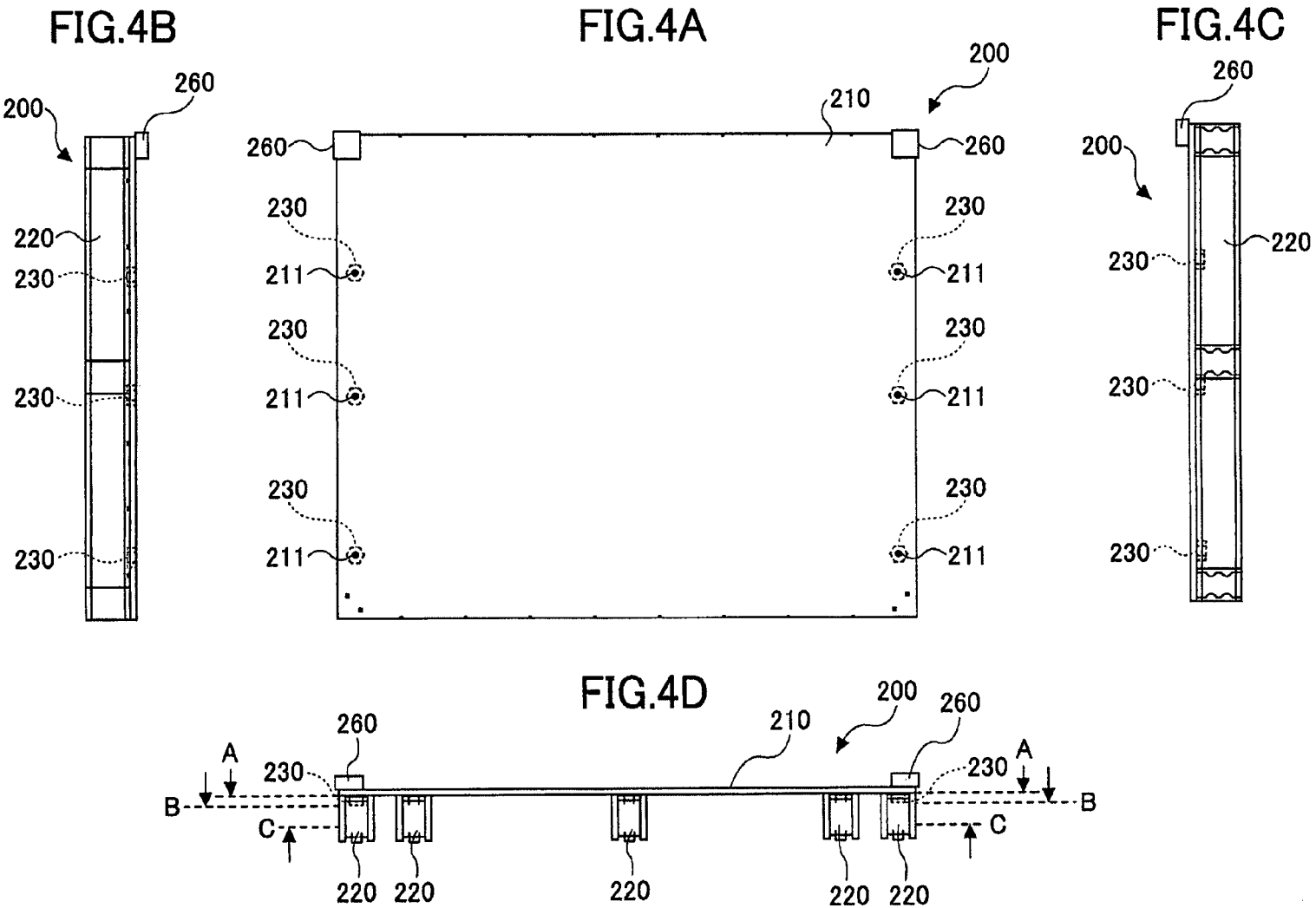
FIG. 4A is a plan view of the pallet base.
FIG. 4B is a left-side view of the pallet base.
FIG. 4C is a right-side view of the pallet base.
FIG. 4D is a front view of the pallet base.

In the mounting plate 210, one or more (three in the illustrated example) bolt insertion openings 211 are provided at positions corresponding to the beam members 220 on both sides (see FIGS. 3 and 4A). Under these bolt insertion openings 211, the welded nuts 230 (fastening unit) are attached (see FIGS. 1, 3, and 4A). Thus, by threading the fixing bolts 340 into the welded nuts 230, the fixing members 300 can be fixed on the pallet base 200. The fixing bolts 340 and the welded nuts 230 are merely preferred examples of the second fastening unit. Preferably, the second fastening unit may include any other technologies as long as the fastening or releasing operation can be performed from a side (which may be referred to as an operation side) opposite an upright portion 330 of the fixing members 300 as will be described in detail later. Preferably, the second fastening unit may include non-welded nuts or any other fastening device capable of being fastened or released from the operation side.

At two corners of the mounting plate 210, positioning members 260 are formed in an upright manner, as illustrated in FIGS. 2A, 3, and 4A, for example. The positioning members 260 determine the position of a square box 610 that surrounds the product 500 disposed on the pallet base 200 as illustrated in FIGS. 2A and 2B. The square box 610, which may be made of cardboard, may be covered with a cover member 620 of also cardboard, thus entirely packaging the product 500.

The fixing members 300 will now be described. As described above, the locations of the screw members 530 on the product 500 may be different between the sides at which the fixing members 300 are disposed. Thus, in accordance with the present embodiment, the fixing members 300 include two fixing members 300A and 300B which have different shapes.

Figure 6:
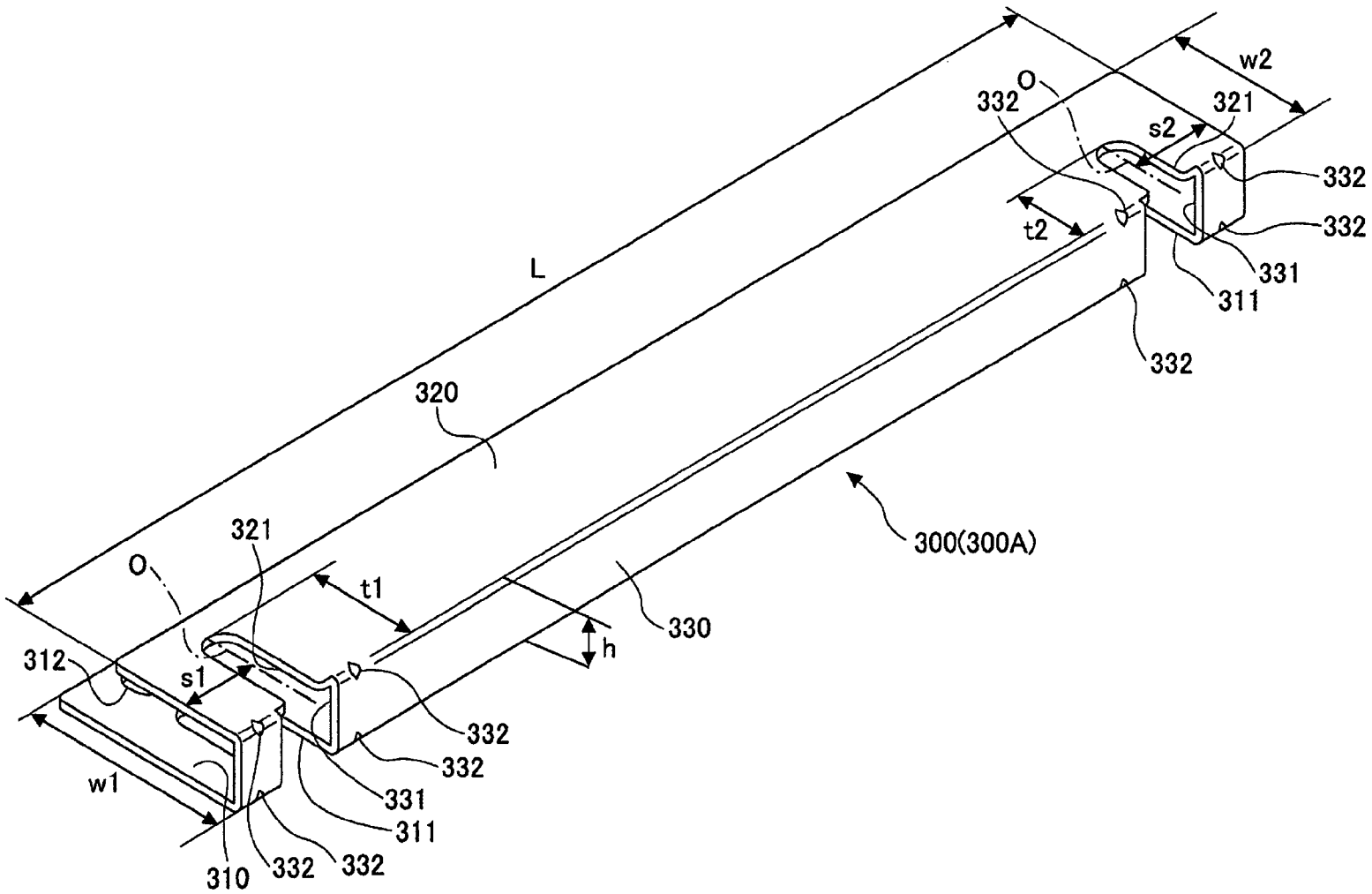
FIG. 6 is a perspective view of one of a pair of fixing members.
Figure 7A:
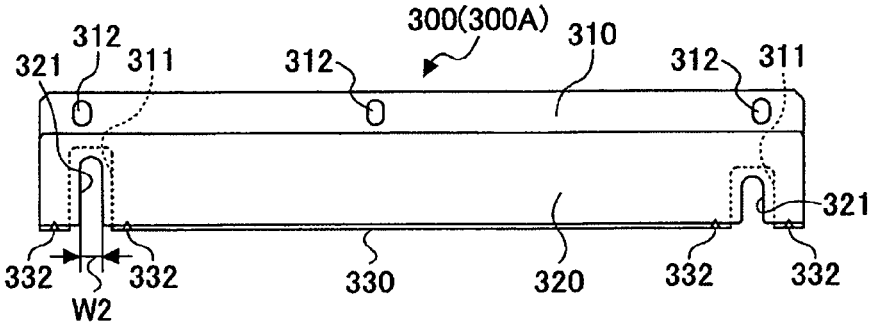
FIG. 7A is a plan view of the fixing member of FIG. 6.
Figure 7D:
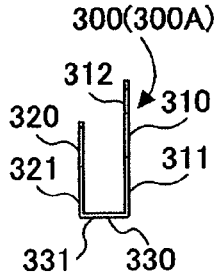
FIG. 7D is a right-side view of the fixing member.
Figure 7B:
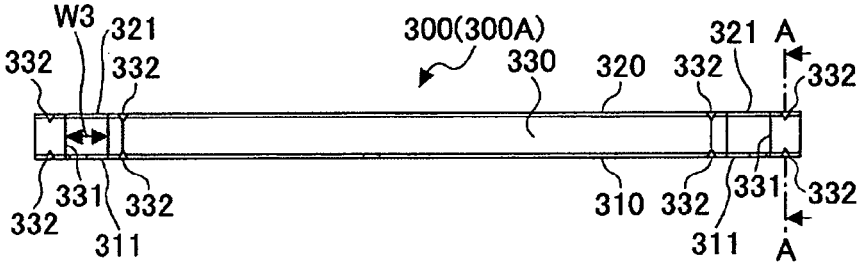
FIG. 7B is a front view of the fixing member.
Figure 7E:
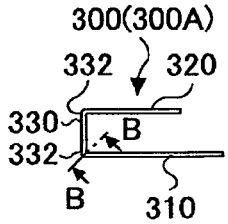
FIG. 7E is a cross section taken along line A-A of FIG. 7B.

FIG. 6 is a perspective view of the fixing member 300A. FIGS. 7A, 7B, 7C, and 7D are a plan view, a front view, a bottom view, and a right-side view, respectively, of the fixing member 300A. FIG. 7E is a cross section taken along line A-A of FIG. 7B. FIG. 7F is a cross section taken along line B-B of FIG. 7E. FIG. 8 is a perspective view of the other fixing member 300B. FIGS. 9A, 9B, 9C, and 9D are a plan view, a front view, a bottom view, and a right-side view, respectively, of the fixing member 300B. FIG. 9E is a cross section taken along line A-A of FIG. 9B. FIG. 9F is a cross section taken along line B-B of FIG. 9E.

The fixing members 300A and 300B in the illustrated example are substantially identical in structure. Thus, in the following description, the fixing members 300A and 300B may be simply designated as the "fixing member 300" unless otherwise required. As illustrated in FIGS. 6 and 8, the fixing member 300 includes a lower surface portion 310, an upper surface portion 320, and an upright portion 330 which connects the lower and upper surface portions 310 and 320 on an inserted side (opposite the operation side) of the fixing member 300, namely on the inside when the fixing member 300 is disposed on the pallet base 200. Thus, the fixing member 300 has a U-shaped cross section (see FIGS. 7D and 9D). The fixing member 300 may be formed by bending a steel plate having a predetermined thickness, such as an electrogalvanized steel plate, such that the fixing member 300 can withstand the weight of the product 500 and shocks during transport. A length L of the fixing member 300 may be slightly smaller than the width of the product 500 where the fixing member 300 is disposed. A width w1 of the lower surface portion 310 and a width w2 of the upper surface portion 320 (w1>w2; see FIGS. 6 and 8) may be determined in view of the position of the fixing bolts 340 of the product 500.

A height h of the upright portion 330 (see FIGS. 6 and 8) may be set to be slightly greater than the height of the upright portion 330 when the product 500 is placed on the fixing members 300 such that no load is applied to the caster units 520. Depending on the weight of the product 500, the fixing members 300 may be made of a material other than steel, such as a synthetic resin.

Figure 7C:
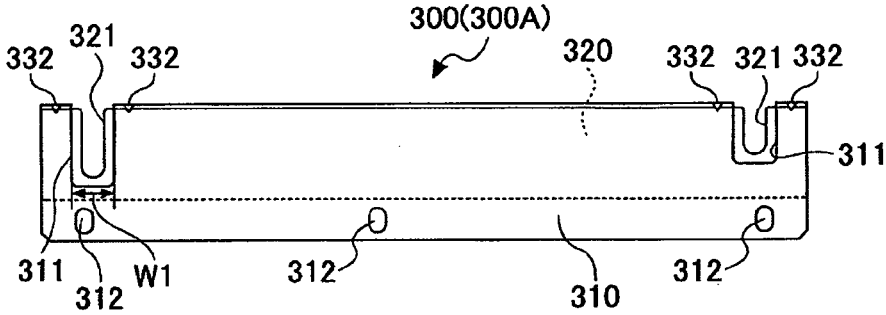
FIG. 7C is a bottom view of the fixing member.
Figure 7F:
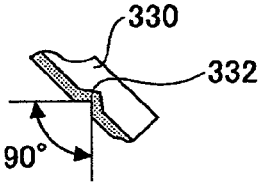
FIG. 7F is a cross section taken along line B-B of FIG. 7E.
Figure 8:
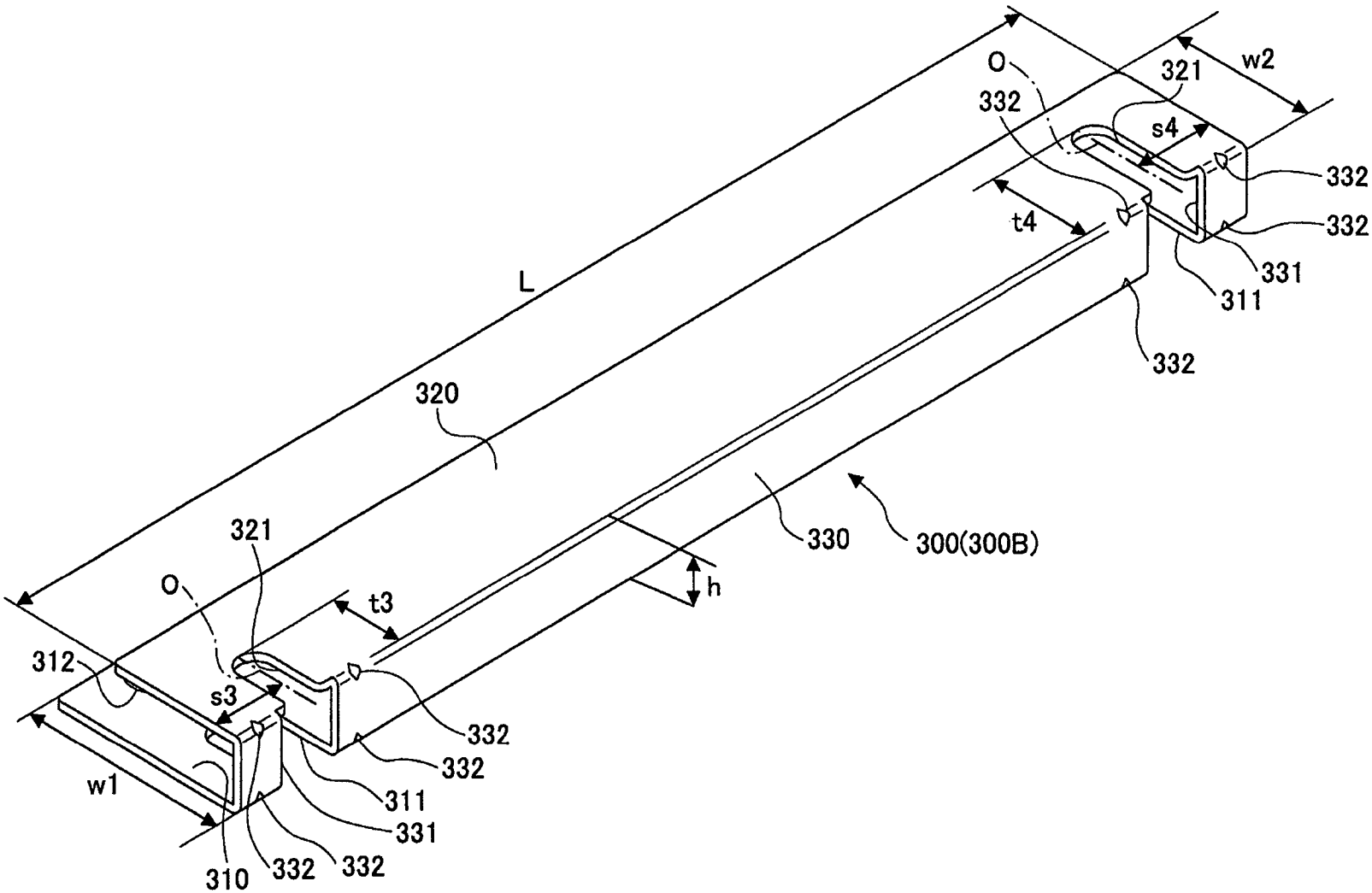
FIG. 8 is a perspective view of the other of the pair of fixing members.

The lower surface portion 310 includes head portion installing slits 311 and fixing bolt insertion openings 312, as illustrated in FIGS. 6 and 7C, for example. The head portion installing slits 311 are opened on the side of the upright portion 330. A width W1 of the head portion installing slits 311 is set to be greater than a maximum diameter D of the head portion 532 of the screw members 530 (see FIGS. 7C, 9C, and 11). The fixing bolt insertion openings 312, in which the fixing bolts 340 are passed through, are formed as elongated openings extended in a width direction of the lower surface portion 310 in alignment with the position of the bolt insertion openings 211 in the pallet base 200 (see FIG. 1).

Figure 9A:
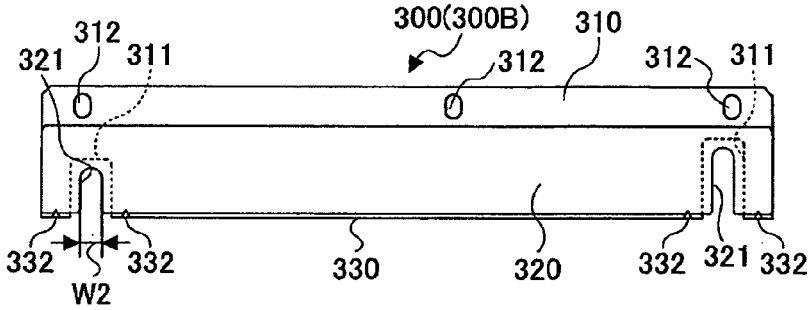
FIG. 9A is a plan view of the fixing member of FIG. 8.
Figure 9D:
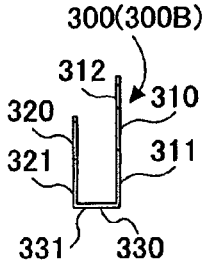
FIG. 9D is a right-side view of the fixing member.

The upper surface portion 320 includes threaded portion inserting slits 321, as illustrated in FIGS. 6, 7A, and 9A. The threaded portion inserting slits 321 are opened on the side of the upright portion 330. A width W2 of the threaded portion inserting slits 321 is set to be greater than the maximum diameter d of the threaded portion 531 of the screw members 530 and smaller than the maximum diameter D (FIG. 11) of the head portion 532.

Figure 9B:
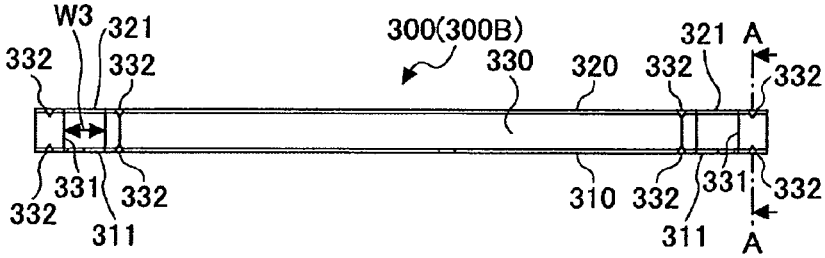
FIG. 9B is a front view of the fixing member.
Figure 9E:
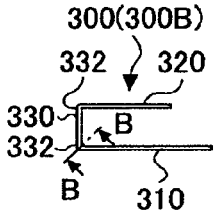
FIG. 9E is a cross section taken along line A-A of FIG. 9B.
Figure 9C:
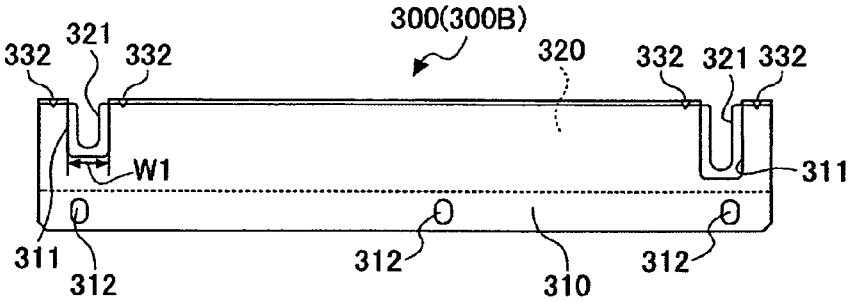
FIG. 9C is a bottom view of the fixing member.
Figure 9F:
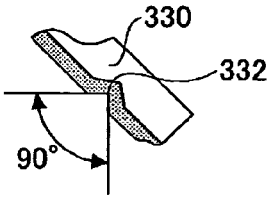
FIG. 9F is a cross section taken along line B-B of FIG. 9B.

The upright portion 330 includes a head portion passing slit 331 continuous with the head portion installing slit 311 of the lower surface portion 310 and the threaded portion inserting slit 321 of the upper surface portion 320, as illustrated in FIGS. 6, 7B, and 9B. A width W3 of the head portion passing slit 331 is set to be greater than the maximum diameter D of the head portion 532 of the screw members 530 and the same as the width W2 of the head portion installing slit 311.

The head portion installing slit 311, the threaded portion inserting slit 321, and the head portion passing slit 331 have a common center line O in the width direction (see FIGS. 6 and 8, for example). The positions of the head portion installing slit 311, the threaded portion inserting slit 321, and the head portion passing slit 331 are determined by the position of the fixing bolts 340 of the product 500. Specifically, a distance (s) between either end of the fixing members 300 and the center line O, and a slit length (t) are determined by the position of the fixing bolts 340 of the product 500. In accordance with the present embodiment, the fixing member 300A has distances s1 and s2 from either end and slit lengths t1 and t2, as illustrated in FIG. 6. The other fixing member 300B has distances s3 and s4 from either end and slit lengths t3 and t4, as illustrated in FIG. 8.

In accordance with the present embodiment, the fixing members 300 configured as described above provide the following effects. With the product 500 installed on the mounting plate 210 via the fixing members 300, when the screw members 530 are fed downward, the head portion 532 of the screw members 530 can directly contact the mounting plate 210 without contacting the lower surface portion 310 of the fixing members 300. Thus, the product 500 can be supported by the screw members 530.

By further extending the screw members 530 downward, the caster units 520 can be retained or "floated" above the pallet base 200. In this state, the fixing members 300 can be detached or inserted laterally with the screw members 530 passing through the head portion installing slit 311, the threaded portion inserting slit 321, and the head portion passing slit 331. Thus, the fixing members 300 can be detached or inserted without the screw members 530 contacting the fixing members 300.

With the product 500 installed on the pallet base 200 via the fixing members 300, the screw members 530 may be threaded in until the head portion 532 of the screw members 530 contacts the sides of the threaded portion inserting slit 321, thus fixing the product 500 on the upper surface portion 320.

As illustrated in FIGS. 7F and 9F, in ridge portions formed between the lower surface portion 310 and the upright portion 330 and between the upper surface portion 320 and the upright portion 330, triangular concave ribs 332 are formed across each of the head portion passing slits 331. The triangular concave ribs 332 may be formed at the time of press working the fixing members 300. The triangular concave ribs 332 prevent cross-sectional deformation of the fixing members 300 and increase their resistance to load or shocks.

Figure 10A:
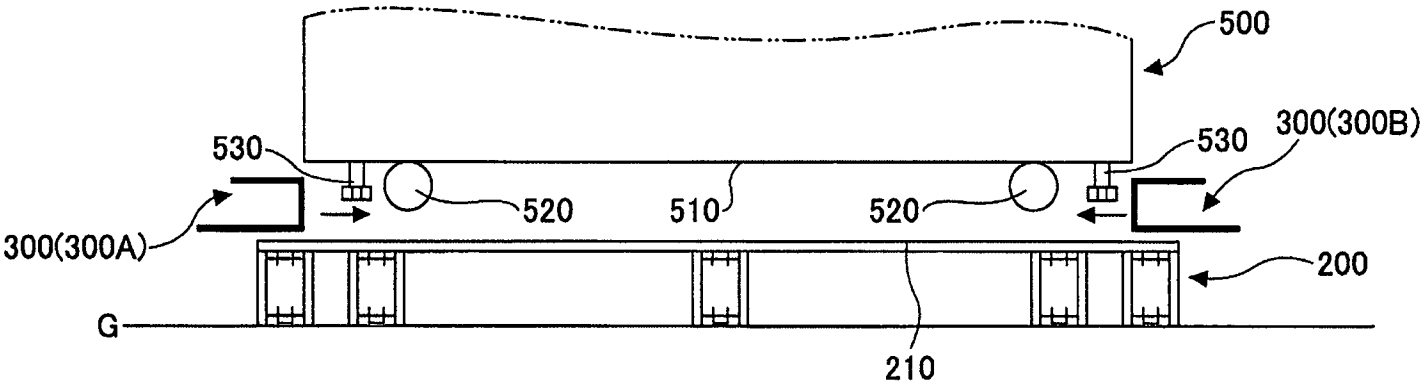
FIGS. 10A through 10E illustrate steps of fixing or releasing the product to or from the pallet apparatus.

A process of fixing and releasing the product 500 to or from the pallet apparatus 100 is described with reference to FIGS. 10A through 10E. When the product 500 is mounted and fixed on the pallet apparatus 100, the product 500 may be lifted by using loading/unloading equipment, such as a forklift, in the present example. First, as illustrated in FIG. 10A, the product 500 is retained or "floated" above the mounting plate 210 of the pallet base 200 by using the forklift and the like. Then, the fixing members 300 are inserted between the product 500 and the mounting plate 210 of the pallet base 200. Specifically, the fixing members 300 are inserted from the upright portions 330 first. The head portion 532 of the screw members 530 may be spaced apart from the bottom surface 510 at least by a distance greater than the thickness of the upper surface portion 320 such that the screw members 530 do not contact the fixing members 300.

Figure 11:
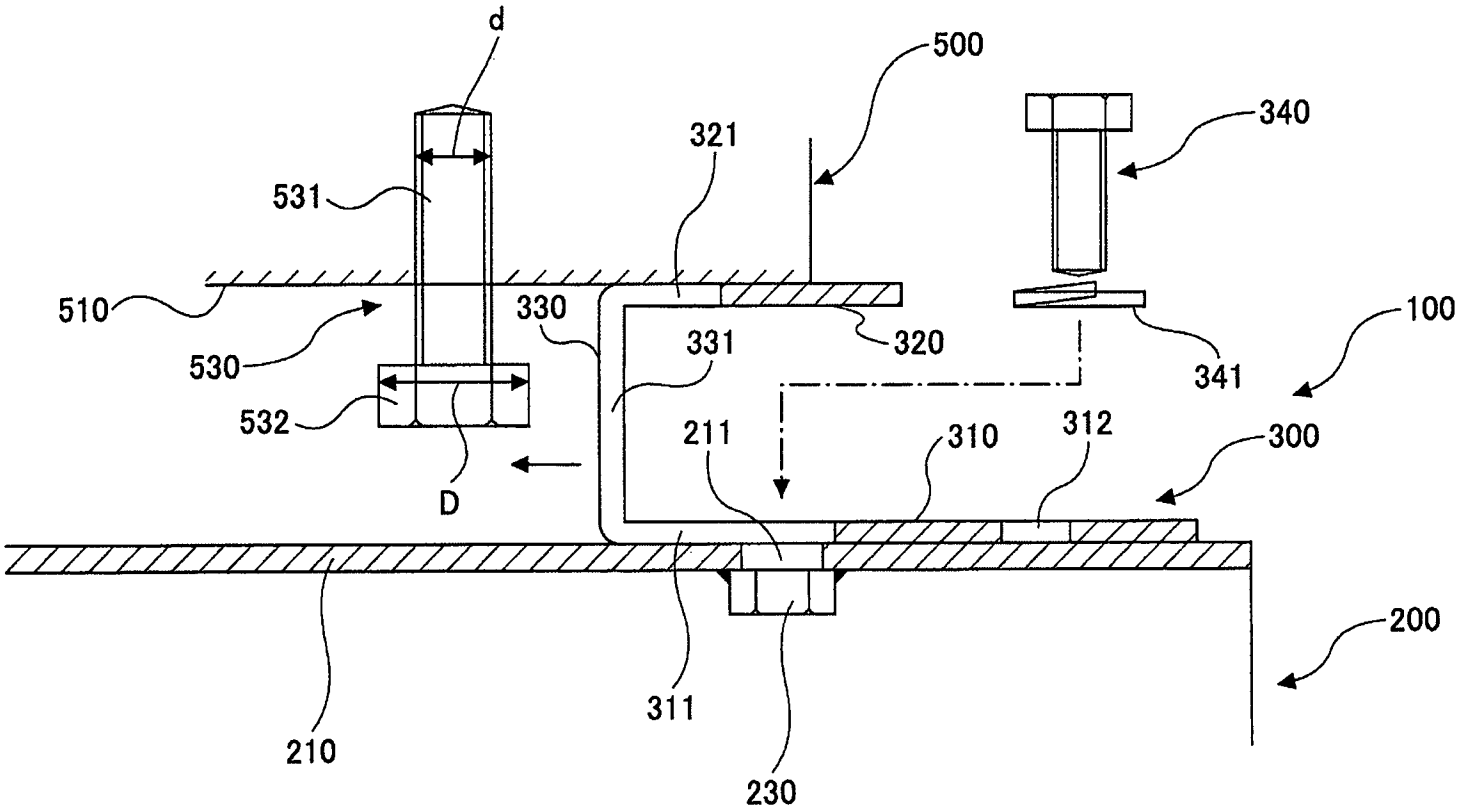
FIG. 11 is an enlarged view illustrating a step of fixing the product to the pallet apparatus.

The width W2 of the threaded portion inserting slit 321 of the upper surface portion 320 is greater than the maximum diameter d of the threaded portion 531 (see FIGS. 9A and 11), and the width W3 of the head portion passing slit 331 of the upright portion 330 is greater than the maximum diameter D of the head portion 532 (see FIGS. 7B, 9B and 11). Thus, as illustrated in FIG. 11, the threaded portion 531 of the screw members 530 attached to the product 500 can pass through the threaded portion inserting slit 321 of the upper surface portion 320, while the head portion 532 can pass through the head portion passing slit 331 of the upright portion 330. Thus, the fixing members 300 can be inserted without contacting the screw members 530 on the product 500. Then, the position of the fixing members 300 is adjusted such that the fixing bolt insertion opening 312 in the lower surface portion 310 of the fixing members 300 is aligned with the bolt insertion opening 211.

Figure 10B:
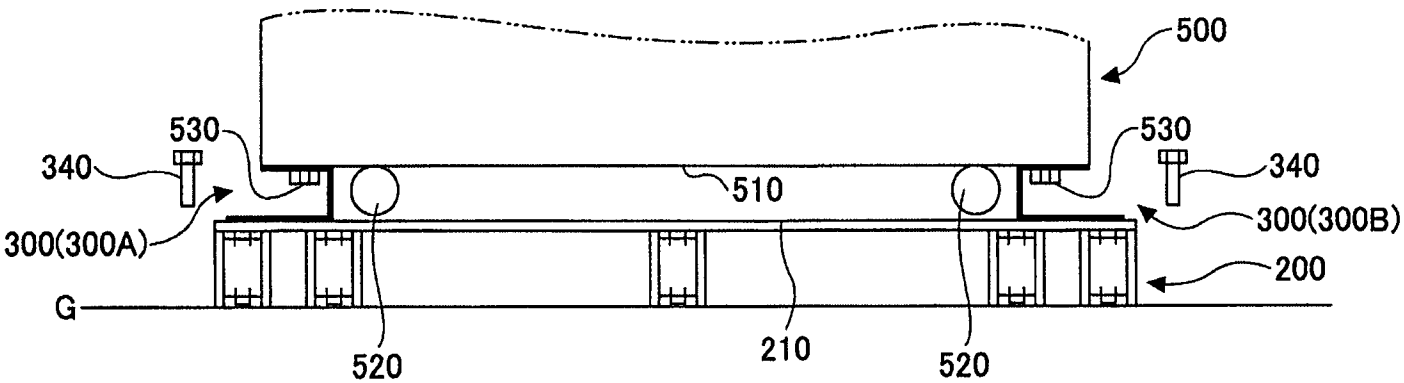

Then, with the fixing members 300 disposed between the product 500 and the pallet base 200, the screw members 530 are threaded into the bottom surface 510 of the product 500, thus fixing the product 500 on the upper surface portion 320 of the fixing members 300 (FIG. 10B). At this time, because the width W2 of the threaded portion inserting slit 321 of the upper surface portion 320 is smaller than the maximum diameter D of the head portion 532, the head portion 532 contacts the upper surface portion 320. Thus, the fixing members 300 and the product 500 can be reliably fixed to each other.

Figure 10C:
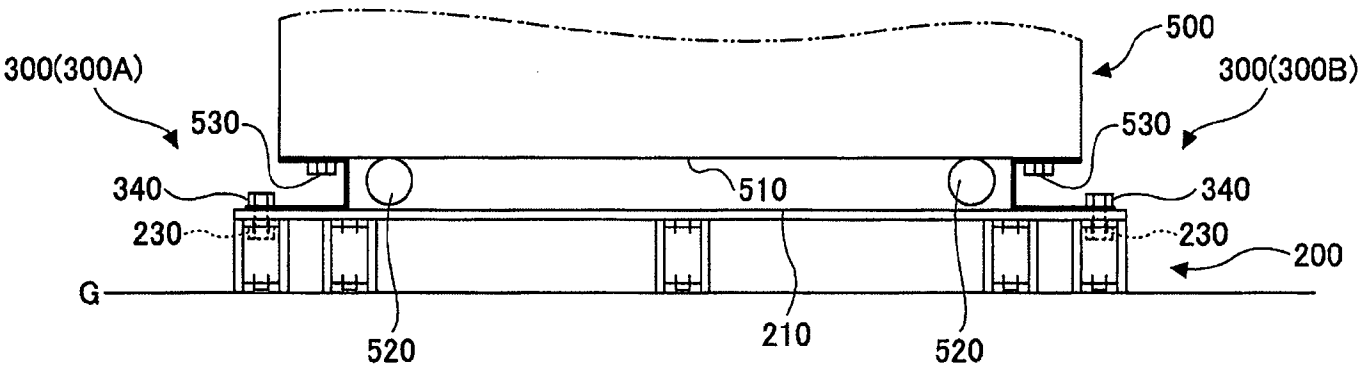
Figure 12:
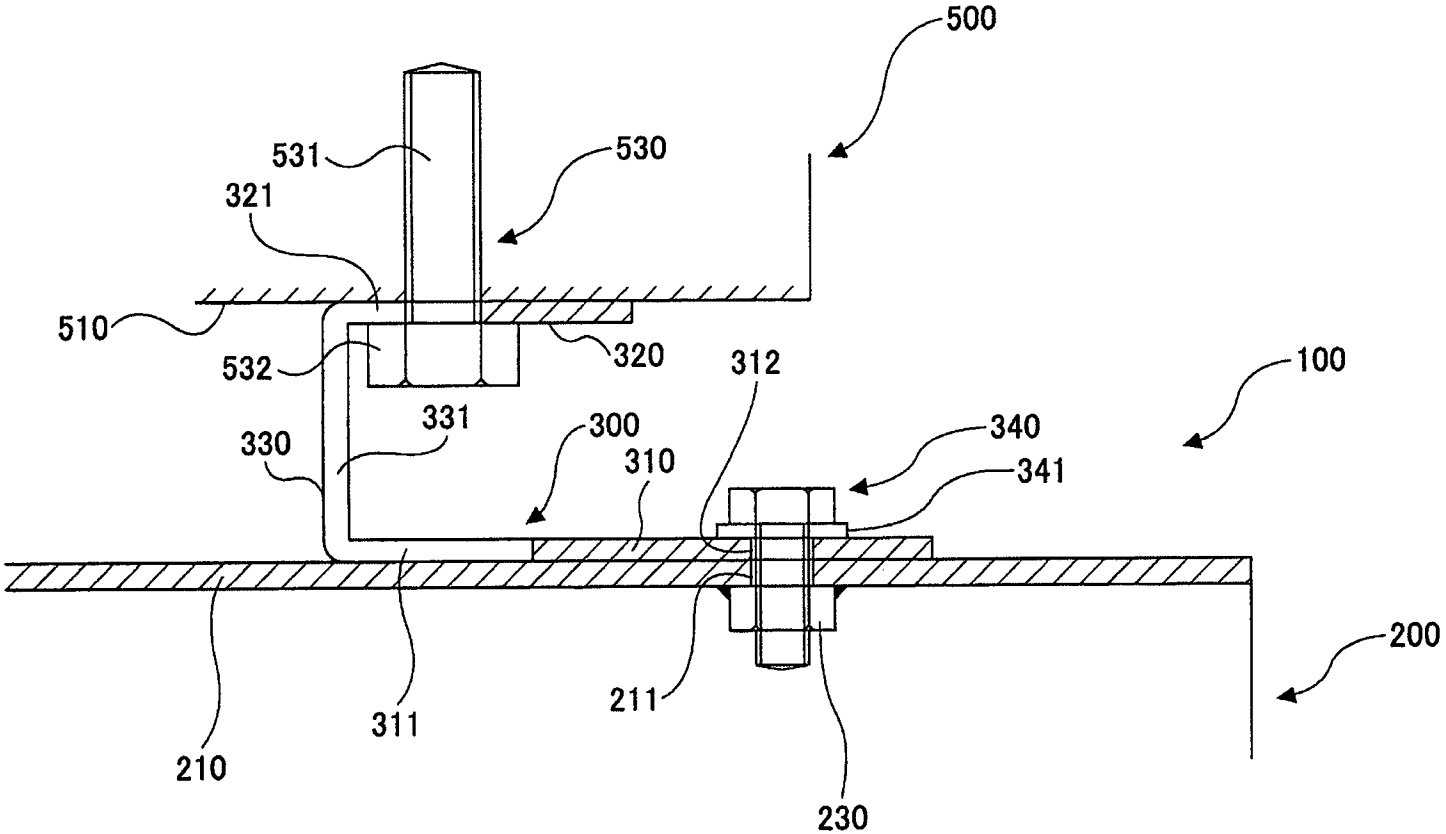
FIG. 12 is an enlarged view of the product fixed on the pallet apparatus.

Thereafter, the fixing bolts 340 are placed in the fixing bolt insertion openings 312 and the bolt insertion openings 211 (see FIG. 13) and threaded into the welded nuts 230, thus fixing the fixing members 300 on the pallet base 200 (FIG. 10C). At this time, because the fixing bolt insertion openings 312 are elongated openings, the fixing bolts 340 can be easily inserted even if the attaching location of the fixing members 300 is slightly displaced. The fixing bolts 340 may be attached via the spring washer 341 (see FIG. 11). Thus, as illustrated in FIGS. 10C and 12, the fixing members 300 are fixed on the pallet base 200, and the product 500 is fixed on the fixing members 300. Thus, the product 500 is fixedly mounted on the pallet apparatus 100.

Figure 10D:
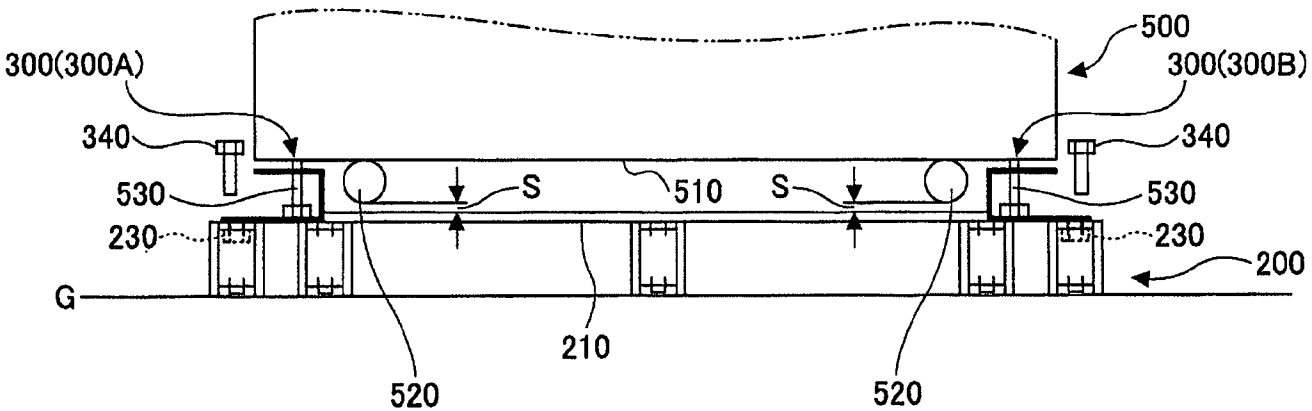
Figure 13:
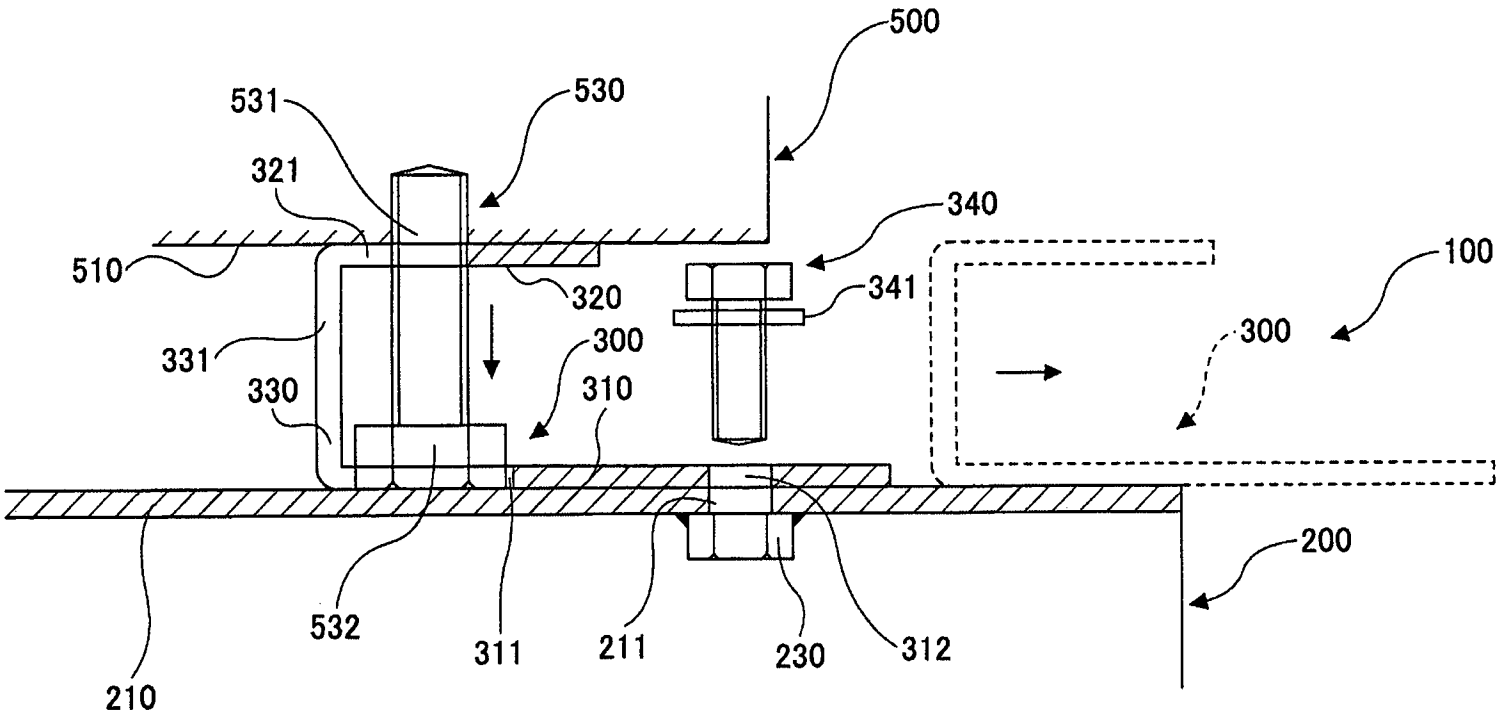
FIG. 13 illustrates a step of releasing the product from the pallet apparatus.

Next, a process of releasing the product 500 from the pallet base 200 is described. In the present example, the product 500 is released at the place of installation without using the loading/unloading equipment such as a forklift. First, the fixing bolts 340 are rotated with a wrench or the like in order to detach the fixing bolts 340 from the welded nuts 230 on the pallet base 200 (FIG. 10D). FIG. 13 illustrates the fixing bolt 340 and the spring washer 341 having been detached from the welded nut 230.

Then, the head portion 532 of the screw members 530 is rotated with a wrench or the like in order to feed the screw members 530 downward with respect to the product 500 until the head portion 532 contacts the mounting plate 210, as illustrated in FIGS. 10D and 13. The head portion 532 is further rotated to feed out the screw members 530 until the product 500 can be lifted with the screw members 530 and the caster units 520 can be retained above the mounting plate 210 with a distance "S" in FIG. 10D. Because the width W1 of the head portion installing slit 311 of the lower surface portion 310 is greater than the maximum diameter D of the head portion 532, the head portion 532 contacts the mounting plate 210 without contacting the lower surface portion 310. At the same time, the fixing of the product 500 on the fixing members 300 by the screw members 530 is released. The operation requires only a tool such as a wrench operated with one hand and is simple. Further, the fixing bolt 340 in front of the screw members 530 is detached before the operation, so that the operation is not hindered by the fixing bolt 340.

Figure 10E:
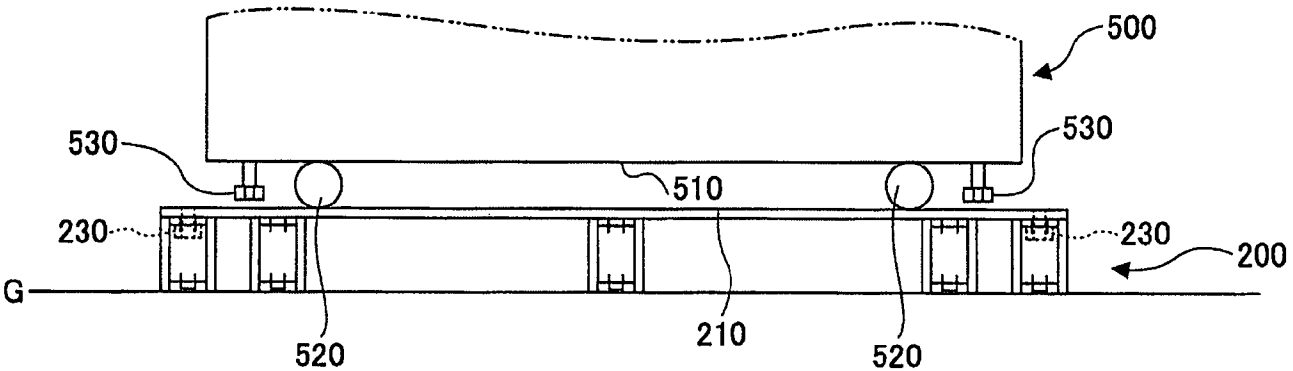

Next, the fixing members 300 are detached outwardly as indicated by an arrow in FIG. 13. At this time, as in the case of inserting the fixing members 300, the fixing members 300 can be easily detached without engaging the screw members 530 because of the head portion installing slit 311, the threaded portion inserting slit 321, and the head portion passing slit 331 formed in the fixing members 300. Then, the screw members 530 are rotated in the opposite direction with a wrench or the like to feed the screw members 530 back into the product 500, until the product 500 is mounted on the mounting plate 210 via the caster units 520 (FIG. 10E). The above releasing operation may be performed for the fixing members 300A and 300B disposed at two locations one at a time.

Thereafter, the product 500 on the casters may be transported from the pallet base 200 onto the floor G by lowering the mounting plate of the pallet apparatus 100 onto the same height as the installing floor by using a lifting machine provided on the loading deck of a truck, or by preparing an unloading ramp made with a board and the like.

Preferably, the product 500 may be mounted and fixed on the pallet apparatus 100 by performing the above releasing process backwardly, instead of using the forklift for lifting. For example, the product 500 is placed on the pallet base 200 using the caster units 520 and then lifted by feeding the screw members 530 downwardly. Then, the fixing members 300 are inserted, the product 500 is fixed on the fixing members 300 by using the screw members 530, and then the fixing members 300 are fixed on the pallet base 200 with the fixing bolts 340.

Thus, in accordance with the present embodiment, the product 500 can be fixed to or released from the pallet base 200 extremely easily by only using a conventional tool, such as a wrench, with one hand. Thus, the efficiency of a loading/unloading operation can be increased.

Embodiment 2

Figure 14:
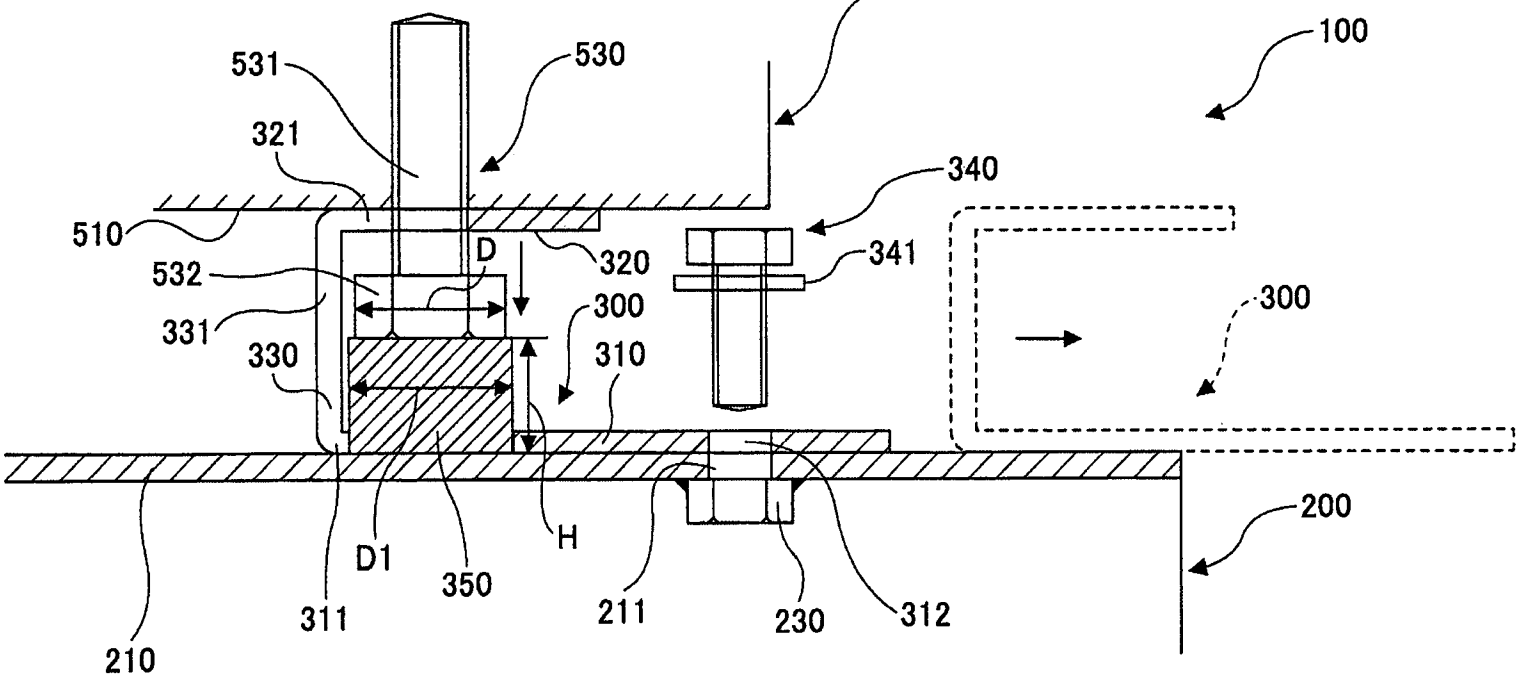
FIG. 14 illustrates a step of releasing the product from the pallet apparatus according to another embodiment.

In accordance with Embodiment 2, the pallet apparatus 100 includes a spacer member 350. FIG. 14 is an enlarged view of the product 500 being released from the pallet apparatus 200 according t Embodiment 2. The spacer member 350 includes a cylindrical member made of a metal or a hard synthetic resin, with a diameter D1 greater than the maximum diameter D of the head portion 532 of the screw members 530 and a height H. In accordance with the present embodiment, when releasing the product 500 from the pallet base 200, the spacer member 350 is disposed on the mounting plate 210 immediately below the fixing bolt 530, namely, within the head portion installing slit 311. In this way, the amount of feeding-out of the fixing bolt 340 can be reduced by the height H, so that the amount of rotation of the head portion 532 for releasing the product 500 can be reduced, thus facilitating and speeding up the operation.

Embodiment 3

Figure 15:
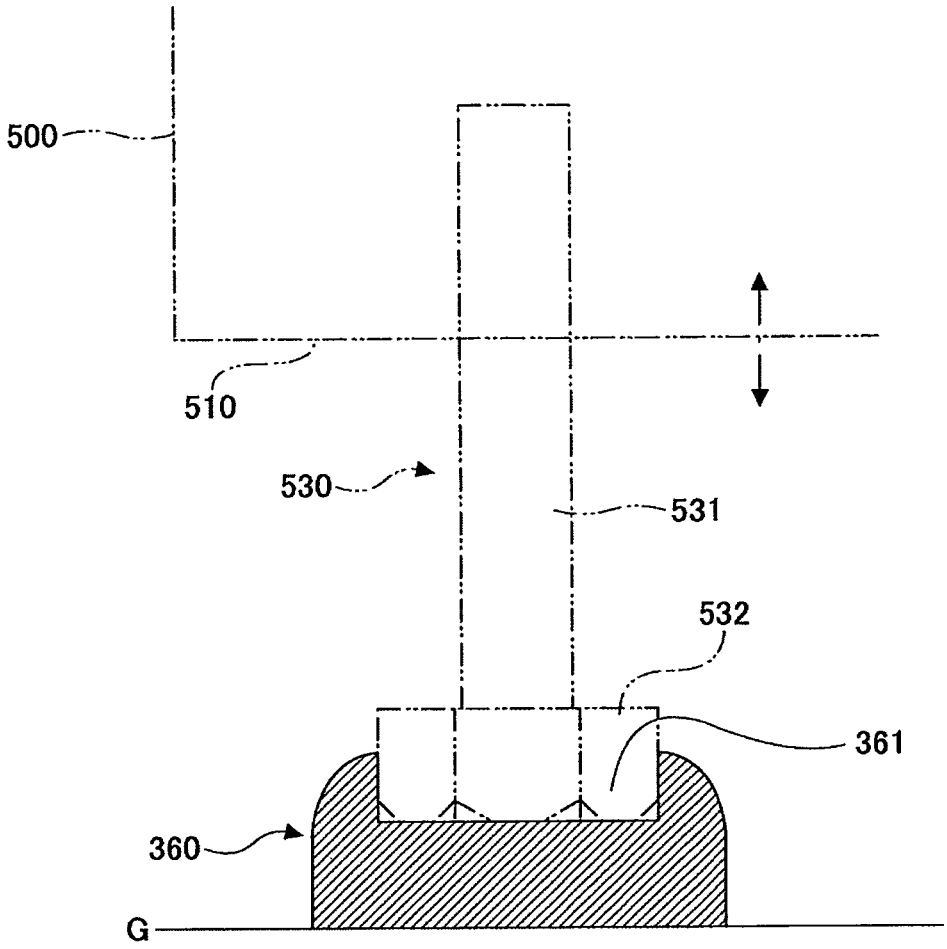
FIG. 15 is a cross section of a receiving member used in the pallet apparatus according to another embodiment.

FIG. 15 is a cross section of a receiving member 360 used in the pallet apparatus 100 according to Embodiment 3. The receiving member 360 may be considered a variation of the spacer member 350 according to Embodiment 2 such that the receiving member 360 can be used between the screw members 530 and the floor G. The receiving member 360 enables the product 500 to be fixedly installed on the floor G, prevents damage to the installation surface G, and reduces the transmission of vibrations to the floor G. The receiving member 360 may include a columnar member of a hard rubber or a synthetic resin with a concave portion 361 formed on top. The concave portion 361 is shaped such that the head portion 532 of the screw members 530 can be fitted therein. In accordance with the present embodiment, the need for separately preparing the receiving member can be eliminated, so that the number of components can be reduced.

Thus, in accordance with an embodiment, a piece of heavy equipment can be released from the pallet easily without using loading/unloading equipment weight, thus increasing the unloading operability.

While the present disclosure describes various embodiments, these embodiments are to be understood as illustrative and do not limit the claim scope. Many variations, modifications, additions and improvements of the described embodiments are possible.

The present application is based on Japanese Priority Application No. 2010-210016 filed Sep. 17, 2010, the entire contents of which are hereby incorporated by reference.

What is claimed is:

1. A pallet apparatus comprising:

a pallet base including a mounting plate configured to mount a product having a plurality of screw members having a variable amount of protrusion from a bottom surface of the product;

a plurality of fixing members configured to support the product on the mounting plate of the pallet base at areas corresponding to a plurality of sides of the bottom surface of the product; and a fastening member configured to fix the plurality of fixing members onto the mounting plate of the pallet base, wherein the product can be fixed on the plurality of fixing members by threading a threaded portion of the plurality of screw members into the bottom surface of the product, wherein the plurality of fixing members include a lower surface portion configured to contact the mounting plate of the pallet base, an upper surface portion configured to contact the bottom surface of the product, and an upright portion configured to connect the upper surface portion and the lower surface portion, the upright portion being disposed at an inside position when the plurality of fixing members are disposed between the product and the mounting plate, wherein the lower surface portion includes a head portion installing slit opened on the side of the upright portion and located at a position corresponding to a position of the plurality of screw members, the head portion installing slit having a width allowing a head portion of the plurality of screw members to directly contact the mounting plate without contacting the lower surface portion, wherein the upper surface portion includes a threaded portion inserting slit opened on the side of the upright portion and located at a position corresponding to the position of the plurality of screw members, the threaded portion inserting slit having a width configured to allow a passage of the threaded portion but not the head portion of the plurality of screw members, so that the product can be fixed on the upper surface portion by the plurality of screw members between the bottom surface of the product and the mounting plate, wherein the upright portion includes a head portion passing slit continuous with the threaded portion inserting slit and the head portion installing slit and having a width allowing a passage of the head portion of the plurality of screw members, and wherein the fastening member is configured to enable the plurality of fixing members to be fastened to or released from the pallet base from outside the upright portion, with the product fixed on the plurality of fixing members with the plurality of screw members.

2. The pallet apparatus according to claim 1, further comprising a spacer member configured to be disposed on the mounting plate of the pallet base at a position corresponding to the plurality of screw members of the product, wherein the spacer member is configured to contact the head portion of the plurality of screw members at a position higher than the mounting plate.

3. The pallet apparatus according to claim 2, wherein the spacer member includes a receiving member configured to be disposed between the plurality of screw members and a product installation surface upon installation of the product.

4. The pallet apparatus according to claim 1, wherein the plurality of screw members include an installed-state adjusting member configured to adjust an installed height and inclination of the product by varying the amount of protrusion from the bottom surface of the product.

5. The pallet apparatus according to claim 1, wherein the plurality of fixing members are disposed under two of a plurality of sides of the product, wherein the two sides are shorter than the remaining sides and are parallel to each other.

6. The pallet apparatus according to claim 1, wherein the product includes an image forming unit and a control unit which are mechanically and electrically connected to each other by an engaging unit.

7. The pallet apparatus according to claim 1, wherein the plurality of fixing members have different shapes.

8. The pallet apparatus according to claim 1, wherein the plurality of fixing members include a triangular concave rib formed in a ridge portion between the upper surface portion and the upright portion or between the lower surface portion and the upright portion.

9. The pallet apparatus according to claim 1, wherein the fastening member includes a plurality of fixing bolts and nuts.

10. The pallet apparatus according to claim 9, wherein the lower surface portion includes an elongated opening configured to pass the fixing bolts.

11. The pallet apparatus according to claim 9, wherein the nuts are welded onto the lower surface portion.

12. The pallet apparatus according to claim 1, wherein the plurality of fixing members are spot-welded onto a lower side of the mounting plate.

13. A pallet apparatus comprising:

a pallet base including a mounting plate configured to mount a product having a plurality of screws having a variable amount of protrusion from a bottom surface of the product, a plurality of fixing members configured to be disposed between the product and the mounting plate of the pallet base and configured to support the product on the mounting plate of the pallet base, wherein the plurality of fixing members include a lower surface portion configured to contact the mounting plate of the pallet base, an upper surface portion configured to contact the bottom surface of the product, and an upright portion disposed at an inside position when the plurality of fixing members are disposed between the product and the mounting plate, the upright portion configured to connect the upper surface portion and the lower surface portion, wherein the lower surface portion includes a first slit for installing a head portion of the plurality of screw members and having a width such that the head portion of the plurality of screw members does not contact the lower surface portion, the first slit being located at a position corresponding to the plurality of screw members and opened on the side of the upright portion, wherein the upper surface portion includes a second slit configured to pass a threaded portion of the plurality of screw members, the second slit having a width allowing a passage of the threaded portion of the plurality of screw members but not the head portion of the plurality of screw members, wherein the upright portion includes a third slit configured to pass the head portion of the plurality of screw members, the third slit being continuous with the first slit and the second slit and having a width allowing a passage of the head portion of the plurality of screw members, wherein the plurality of fixing members can be fixed to or released from the pallet apparatus by adjusting the amount of protrusion of the plurality of screw members from the bottom surface of the product.

14. The pallet apparatus according to claim 13, further comprising a pair of the fixing members disposed opposite to each other on the mounting plate of the pallet base.

15. The pallet apparatus according to claim 13, wherein the plurality of screw members include an installed-state adjusting member configured to adjust an installed height and inclination of the product by varying the amount of protrusion of the plurality of screw members from the bottom surface of the product.

16. The pallet apparatus according to claim 13, further comprising a spacer member configured to be disposed on the mounting plate of the pallet base at a position corresponding to the plurality of screw members of the product, wherein the spacer member is configured to contact the head portion of the plurality of screw members at a position higher than the mounting plate.

17. The pallet apparatus according to claim 16, wherein the spacer member includes a receiving member configured to be disposed between the plurality of screw members and a product installation surface upon installation of the product.

18. A pallet apparatus comprising:

a pallet base including a mounting plate configured to mount a product having a first fastening unit;

a fixing member disposed between the product and the mounting plate of the pallet base; and a second fastening unit configured to fix the fixing member onto the mounting plate, wherein the fixing member includes a lower surface portion configured to contact the mounting plate of the pallet base, an upper surface portion configured to contact a bottom surface of the product, and an upright portion configured to connect the upper surface portion and the lower surface portion, wherein the product can be fixed to or released from the fixing member by fastening or unfastening the first fastening unit, wherein the fixing member includes a slit at a position corresponding to the first fastening unit, the slit configured to be continuous over the lower surface portion, the upper surface portion, and the upright portion and configured to allow the fixing member to be inserted between or detached from the product and the mounting plate without contacting the first fastening unit.

* * * * *